US011199069B2

(12) United States Patent
Fripp et al.

(10) Patent No.: US 11,199,069 B2
(45) Date of Patent: Dec. 14, 2021

(54) SEALS BY MECHANICALLY DEFORMING DEGRADABLE MATERIALS

(71) Applicant: Halliburton Energy Services, Inc., Houston, TX (US)

(72) Inventors: Michael Linley Fripp, Carrollton, TX (US); Stephen Michael Greci, Little Elm, TX (US); Terapat Apicharthabrut, Plano, TX (US); Maxime P M Coffin, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/320,006

(22) PCT Filed: Feb. 22, 2018

(86) PCT No.: PCT/US2018/019196
§ 371 (c)(1),
(2) Date: Jan. 23, 2019

(87) PCT Pub. No.: WO2019/164492
PCT Pub. Date: Aug. 29, 2019

(65) Prior Publication Data

US 2021/0156223 A1 May 27, 2021

(51) Int. Cl.
*E21B 29/02* (2006.01)
*E21B 43/08* (2006.01)
(Continued)

(52) U.S. Cl.
CPC ..... *E21B 34/06* (2013.01); *E21B 29/02* (2013.01); *E21B 43/08* (2013.01); *E21B 43/12* (2013.01); *E21B 33/12* (2013.01); *E21B 2200/06* (2020.05)

(58) Field of Classification Search
CPC ..... E21B 43/08; E21B 29/02; E21B 33/12
See application file for complete search history.

(56) References Cited

U.S. PATENT DOCUMENTS 6,568,472 B1 5/2003 Gano et al.
2002/0088744 A1* 7/2002 Echols ..... E21B 43/08 210/170.01

(Continued)

FOREIGN PATENT DOCUMENTS

WO WO 2017/116477 A1 7/2017

OTHER PUBLICATIONS

International Search Report and the Written Opinion of the International Search Authority dated Nov. 20, 2018, PCT/US2018/019196, 14 pages, ISA/KR.

*Primary Examiner* — Catherine Loikith
(74) *Attorney, Agent, or Firm* — Haynes and Boone, LLP

(57) ABSTRACT

A tubular sleeve is made of a degradable material and may be disposed within a downhole component or may be disposed around an outer surface of the downhole component. The tubular sleeve is positioned relative the downhole component such that fluid flow is prevented from passing through at least one aperture in the downhole component. The tubular sleeve is secured to the downhole component by swedging, mechanical fasteners, or adhesives. In the swedging process, the tubular sleeve is mechanically deformed by applying a force to the sleeve, which stretches and then recoils back an amount once the force is removed. Once installed, the tubular sleeve will eventually degrade, allowing fluid to flow through the at least one aperture in the downhole component.

20 Claims, 8 Drawing Sheets

(51) Int. Cl.

| | |
|---|---|
| ***E21B 33/12*** | (2006.01) |
| ***E21B 34/06*** | (2006.01) |
| ***E21B 43/12*** | (2006.01) |

(56) References Cited

U.S. PATENT DOCUMENTS

| | | | | |
|---|---|---|---|---|
| 2003/0000875 | A1* | 1/2003 | Echols ..... | E21B 47/00 210/85 |
| 2004/0134656 | A1 | 7/2004 | Richards | |
| 2009/0032255 | A1 | 2/2009 | Surjaatmadja et al. | |
| 2015/0337623 | A1 | 11/2015 | Carrejo | |
| 2016/0024897 | A1 | 1/2016 | Greci et al. | |

* cited by examiner

SEALS BY MECHANICALLY DEFORMING DEGRADABLE MATERIALS

PRIORITY

The present application is a U.S. National Stage patent application of International Patent Application No. PCT/US2018/019196, filed on Feb. 22, 2018, the benefit of which is claimed and the disclosure of which is incorporated herein by reference in its entirety.

TECHNICAL FIELD

The present disclosure generally relates to oilfield equipment and, in particular, to downhole tools, and related systems and techniques for completing, servicing, and evaluating wellbores in the earth. More particularly still, the present disclosure relates to systems and methods for providing a temporary seal during installation of downhole components.

BACKGROUND

The present disclosure relates generally to operations performed and equipment utilized in conjunction with subterranean wells and, in an embodiment described herein, more particularly provides systems and methods for providing a temporary seal during installation of downhole components to block the fluid flow between the inner diameter of a tubing and the formation.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Figure 1:
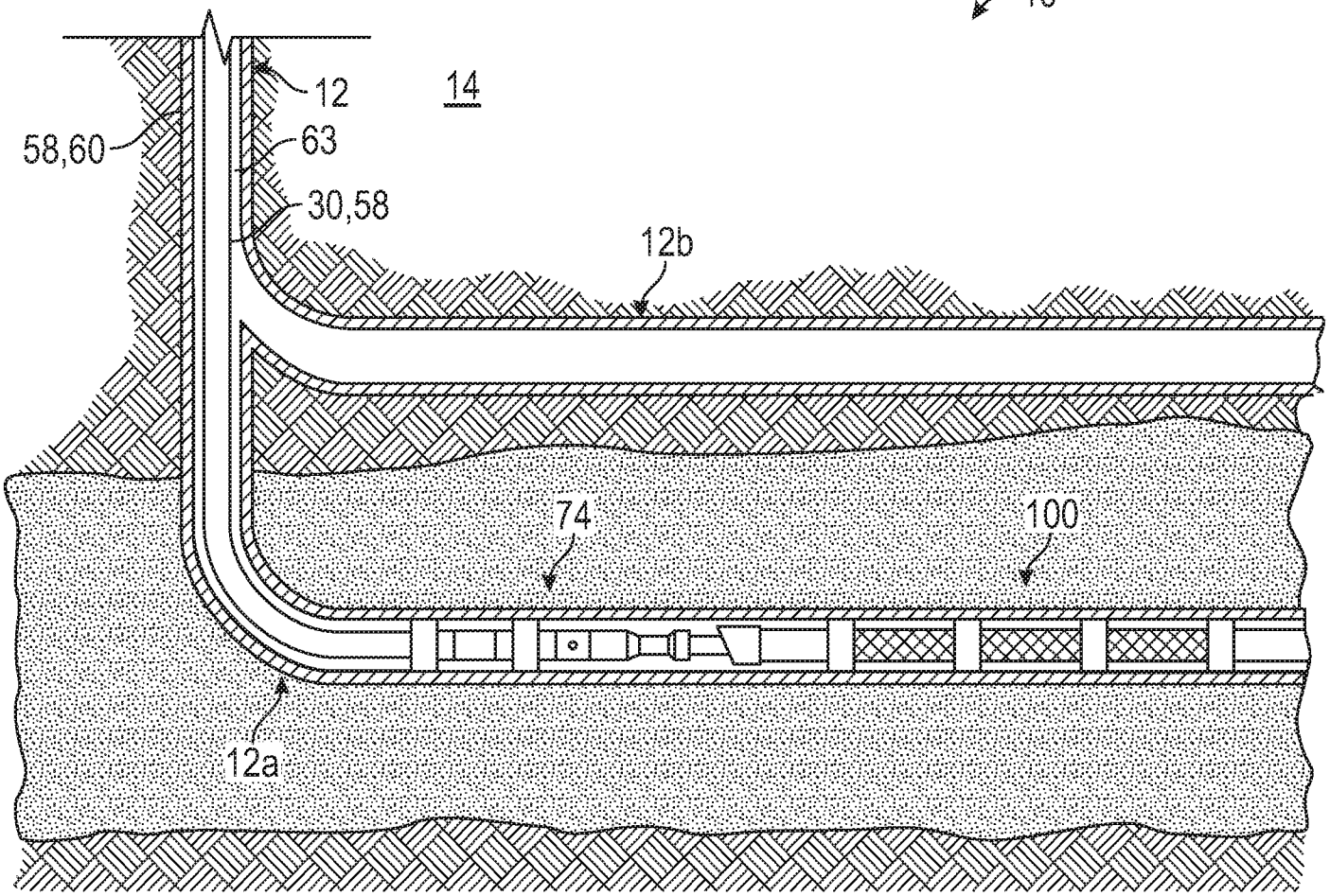
FIG. 1 is an elevation view in partial cross section of a cased well completion system including a temporary sealing device according to an embodiment.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover, even though a figure may depict a horizontal wellbore or a vertical wellbore, unless indicated otherwise, it should be understood by those skilled in the art that the apparatus according to the present disclosure is equally well-suited for use in wellbores having other orientations including slanted wellbores, multilateral wellbores, or the like. Likewise, unless otherwise noted, even though a figure may depict an offshore operation, it should be understood by those skilled in the art that the apparatus according to the present disclosure is equally well-suited for use in onshore operations and vice-versa.

Turning to FIG. 1, shown is an elevation view in partial cross-section of a cased well completion system 10 including a temporary sealing device 100 used to block flow between an inner diameter and an outer diameter of a downhole component. The cased wellbore completion system 10 is used to produce hydrocarbons from wellbore 12 extending through various earth strata in an oil and gas formation 14 located below the earth's surface (not shown). Wellbore 12 may be formed of a single or multiple bores 12*a*, 12*b*, . . . 12*n*, extending into the formation 14, and disposed in any orientation.

System 10 may include coiled tubing, production tubing, other types of pipe or tubing strings or other types of conveyance vehicles such as wireline, slickline, and the like 30. In FIG. 1, conveyance vehicle 30 is completion tubing supporting a completion assembly as described below. One or more pressure control devices, such as blowout preventers (BOPS) and other equipment associated with producing a wellbore may also be provided at a wellhead (not shown) or elsewhere in the system 10. System 10 may be a land-based system or a marine-based production system, and may generally be characterized as having a pipe system 58. For purposes of this disclosure, pipe system 58 may include casing, risers, tubing, completion or production strings, subs, heads or any other pipes, tubes or equipment that couples or attaches to the foregoing, such as tubing string 30, conduit, joints, collars or latch couplings, and latch couplings as well as the wellbore 12 and laterals in which the pipes, casing and strings may be deployed. In this regard, pipe system 58 may include one or more casing strings 60 that may be cemented in wellbore 12, such as the surface, intermediate and production casings 60 shown in FIG. 1. An annulus 63 is formed between the walls of sets of adjacent tubular components, such as concentric casing strings 60 or the exterior of tubing string 30 and the inside wall of wellbore 12 or casing string 60, as the case may be.

Pipe system 58 may include various other tools 74; for example, tool 74 may be a fluid injection assembly (and individual components) for injection of one or more substances including, but not limited to, water, brine, polymers, bactericides, algaecides, corrosion inhibitors, hydrocarbons, or any combination thereof. Tool 74 may also be a gas injection assembly (and individual components) for injection of one or more substances including, but not limited to, carbon dioxide, carbon monoxide, air, hydrocarbons, nitrogen, inert gases, or any combination thereof. Tool 74 may further be a hydrocarbon recovery system (and individual components) for the recovery of hydrocarbons (e.g., oil, gas, or any combination thereof) and any natural occurring byproduct recovered during the recovery of hydrocarbons (e.g., water, brine, non-hydrocarbon gases (such as nitrogen, carbon dioxide, etc.), traces of minerals and solids such as sulfur, quartz, sand, silt, clay, etc. The hydrocarbon recovery system may be any type of hydrocarbon recovery system known in the art including, but not limited to, gas-lift, artificial lift (e.g., rod & pump, submersible pump, etc.), natural lift (i.e., flowing wells), intelligent wells (wells monitored and/or controlled from the surface, downhole-controlled wells), multilateral completions, combination completions, single string lower-pressure/low-temperature wells (LP/LT), single-string medium-pressure/medium-temperature wells (MP/MT), single-string high-pressure/high-temperature (HP/HT) wells, multi-string LP/LT wells, multi-string MP/MT wells, multi-string HP/HT wells, multiple-zone single-string selective completion, dual-zone completion using parallel tubing strings, bigbore, and monobore completions.

Figure 2A:
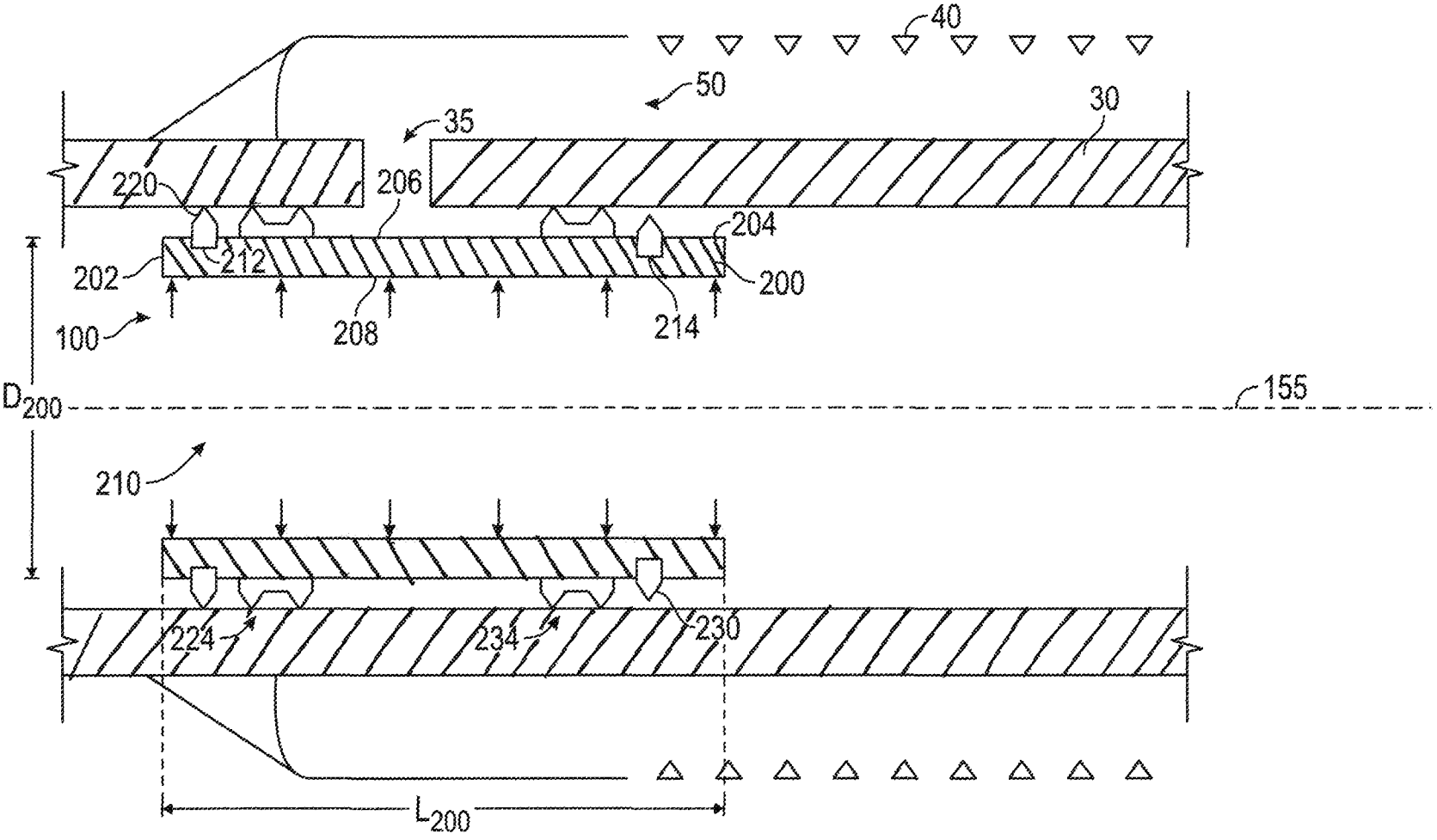
FIGS. 2A and 2B are cross sectional views of the protection sleeve assembly of FIG. 1 in different orientations.

Referring now to FIG. 2A, showing the temporary sealing device 100 disposed within tubing string 30 of FIG. 1. Temporary sealing device 100 comprises a sleeve portion 200 coaxial about a central axis 155. As illustrated, the sleeve portion 200 is generally tubular with a first end 202, a second end 204, an outer surface 206 extending therebetween, and an inner surface 208 defining a passageway 210. The sleeve portion 200 has a length $L_{200}$ and a diameter $D_{200}$, and may also be called a sleeve, a tube, or a tubular sleeve 200. In some embodiments, sleeve portion 200 may exhibit a C-shaped or other non-circular cross section. The sleeve 200 is made of a degradable material that may be a metal, a glass, or a polymer. In an embodiment, the sleeve 200 may be made of a degradable metal including, but not limited to, aluminum alloys, magnesium alloys, and calcium alloys. Sleeve 200 may be one long sleeve component or a plurality of sleeves placed axially end to end. In an embodiment, the length $L_{200}$ of each sleeve 200 may be approximately one inch long to over thirty feet long, and preferably, may be approximately six inches to twenty-four inches long.

In an embodiment, the sleeve portion 200 further includes a first seal 220 disposed proximate the first end 202 and a second seal 230 disposed proximate the second end 204. The first and second seals 220, 230, respectively, are disposed around the outer surface 206 of sleeve 200 and may be disposed in grooves 212, 214, respectively, in sleeve outer surface 206. The seals 220, 230 may be any type of seal known in the art, and preferably made from a degradable material. In the embodiment shown in FIG. 2, seals 220, 230 are O-rings made of an erodible material. In some embodiments, the seals 220, 230 are constructed of an elastomer that partially comprises poly glycolic acid (PGA), polylactic acid (PLA), polyvinyl alcohol (PVA), polyurethane, an aliphatic polyester, natural rubber. In other embodiments, the seals 220, 230 may be formed as a profiles defined on the outer surface 206 of the sleeve portion 200 that, when mechanically deformed into the tubing string 30, forms a metal-to-metal seal therewith.

Sleeve 200 may further comprise a first molded seal 224 and a second molded seal 234 disposed on outer sleeve surface 206; the first molded seal 224 may be disposed proximate the first end 202 and the second molded seal 234 may be disposed proximate the second end 204. First and second molded seals 224, 234, respectively, may each be a single seal with multiple contact surfaces or may comprise two or more seals spaced apart. The first and second molded seals 224, 234, respectively, may be any molded seal(s) known in the art, and preferably made from a degradable material, e.g., the molded seals 224, 234 may be constructed of any of same the materials of which the seals 220, 230 are constructed as described above.

The seals 220, 230 and molded seals 224, 234 may be axially arranged in any order relative each other on outer surface 206 of sleeve 200. For example, the seal order may be first seal 220, then first molded seal 224 proximate first end 202 of sleeve 200, then second seal 230, and then second molded seal 234 proximate second end 204 of sleeve; the seal order may also be first molded seal 224, first seal 220 proximate first end 202, and then second seal 230, second molded seal 234 proximate second end. In the embodiment shown in FIG. 2, the seal order is first seal 220, first molded seal 224 proximate first end 202, and second molded seal 234, second seal 230 proximate second end 204.

The sleeve 200 with seals 220, 230 and molded seals 224, 234 is disposed within a downhole component, such as tubing string 30. Sleeve 200 is positioned within tubing 30 to overlap or cover one or more apertures or perforations 35 in the tubing 30 through which a production flow path 50 passes. The one or more apertures may be any type of hole or grouping of holes including, but not limiting to, production tubing holes, workover string holes, and tubular string holes. The quantity, configuration, and spacing of the sleeves 200 may depend on the quantity and location of apertures or perforations 35 to be blocked or covered. In an embodiment, one long sleeve 200 or a plurality of sleeves placed axially end to end may be used to overlap or cover one or more apertures or perforations. In another embodiment, a plurality of sleeves 200 of the same length or varying lengths may be spaced apart with each sleeve 200 overlapping or covering one or more apertures or perforations. The one or more apertures or perforations 35 may be a single aperture, a plurality of single perforations spaced apart, a group or cluster of perforations, or a plurality of clusters of apertures with each cluster spaced apart from another cluster. Thus, one sleeve 200 may cover or block a single perforation or hole 35, a group of perforations, or multiple groups of perforations. For example, sleeve 200 may be used to cover or block a screen joint.

Figure 2B:
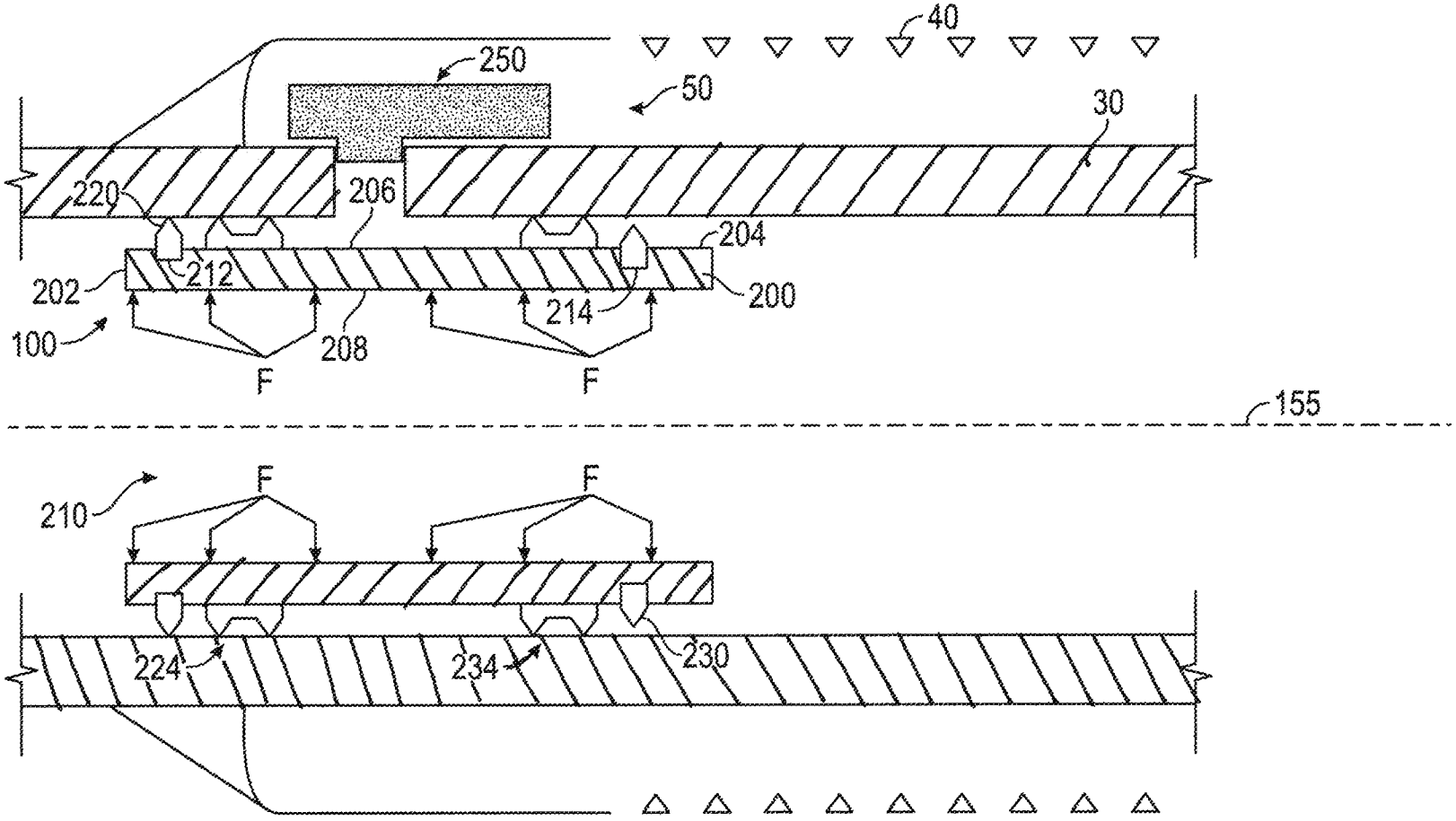

Referring now to FIG. 2B illustrating the temporary sealing device 100 of FIG. 2A with a restriction device 250 disposed in or covering one of the apertures 35. The restriction device 250 may be used to control flow (e.g., production flow path 50) through one of the apertures 35. The restriction device may be any flow control device standard in the art including, but not limited to, an inflow control device (ICD), an autonomous inflow control device (AICD), an autonomous inflow control valve (AICV), and an inflow control valve (ICV). One or more restriction devices 250 may be used in various apertures or holes 35 at various locations in the tubing string 30.

The diameter $D_{200}$ of sleeve 200 is generally sized to fit within tubing string 30 to place seals 220, 230 and molded seals 224, 234 in contact with both the sleeve outer surface 206 (including grooves 212, 214) and an inner surface of the tubing string 30. A shroud, mesh filter 40 or other filter media may be disposed about the tubing string 30. The filter media may include a shroud, a mesh filter, and/or a screen jacket. In other embodiments, a filter media can be constructed in other manners recognized in the art such as a wrap on pipe, which does not employ a shroud and a mesh. In an embodiment both a shroud and a mesh filter may be used; in a further embodiment, a plurality of shrouds, a plurality of mesh filters, or a plurality of both shrouds and mesh filters may be used.

The sleeve 200 is held in place within tubing string 30 by a swedging process. The sleeve 200 is mechanically deformed by applying a force F radially outward to the sleeve inner surface 208 to keep the sleeve in place within tubing string 30 and block flow through aperture 35 between the inner diameter and the outer diameter of the tubing string 30. The mechanical deformation may be performed by any means standard in the art including, but not limited to, a mechanical cone, a hydraulic setting tool, an expandable packer, explosive forming, pressure, and hydraulic forces. The mechanical deformation may be done at the surface prior to installation in the wellbore 12 (FIG. 1), or after the tubing string 30 or other completion is installed. In an alternative embodiment, the sleeve 200 could be placed on the outside of the tubing string 30 and mechanically deformed inward with a crimping process. Alternatively, the sleeve 200 could be mechanically connected to the tubing string with an adhesive (such as epoxy), a braze, or an interference fit. As shown in FIG. 2A, the sleeve 200 is axially pressure balanced so that the axial forces are minimized.

During the mechanical deformation, the sleeve 200 is stretched and then recoils back an amount generally less than the initial stretch amount. In the embodiment shown in FIGS. 2A and 2B, the sleeve 200 is swedged to a larger diameter. The recoil of the sleeve 200 may create a leak path. In the embodiments shown in FIGS. 2A and 2B, as the sleeve 200 elastically recoils back after the mechanical deformation, the seals 220, 230 and molded seals 224, 234 fill the gap to block the potential leak path caused by the elastic recoil. In this embodiment, only the sleeve 200 is mechanically deformed, leaving the tubing string 30 not yielded. The amount of elastic recoil is dependent on the material used for the sleeve 200 as well as the thickness of the sleeve 200, which determines how the material yields when pressurized, activated, or mechanically deformed.

In some embodiments, both the sleeve 200 and the tubing string 30 may be plastically deformed by the mechanical deformation of the sleeve 200. In this manner, gaps or leak paths due to the recoil may be eliminated. In some embodiments, the sleeve 200 may be plastically deformed while the tubing string 30 is only elastically deformed, e.g., such that the sleeve 200 maintains a deformed configuration while tubing string 30 returns to its original size and shape after the load F is relieved. At least one embodiment of deforming the tubing string 30 is discussed below, e.g., with reference to FIG. 3.

Figure 3:
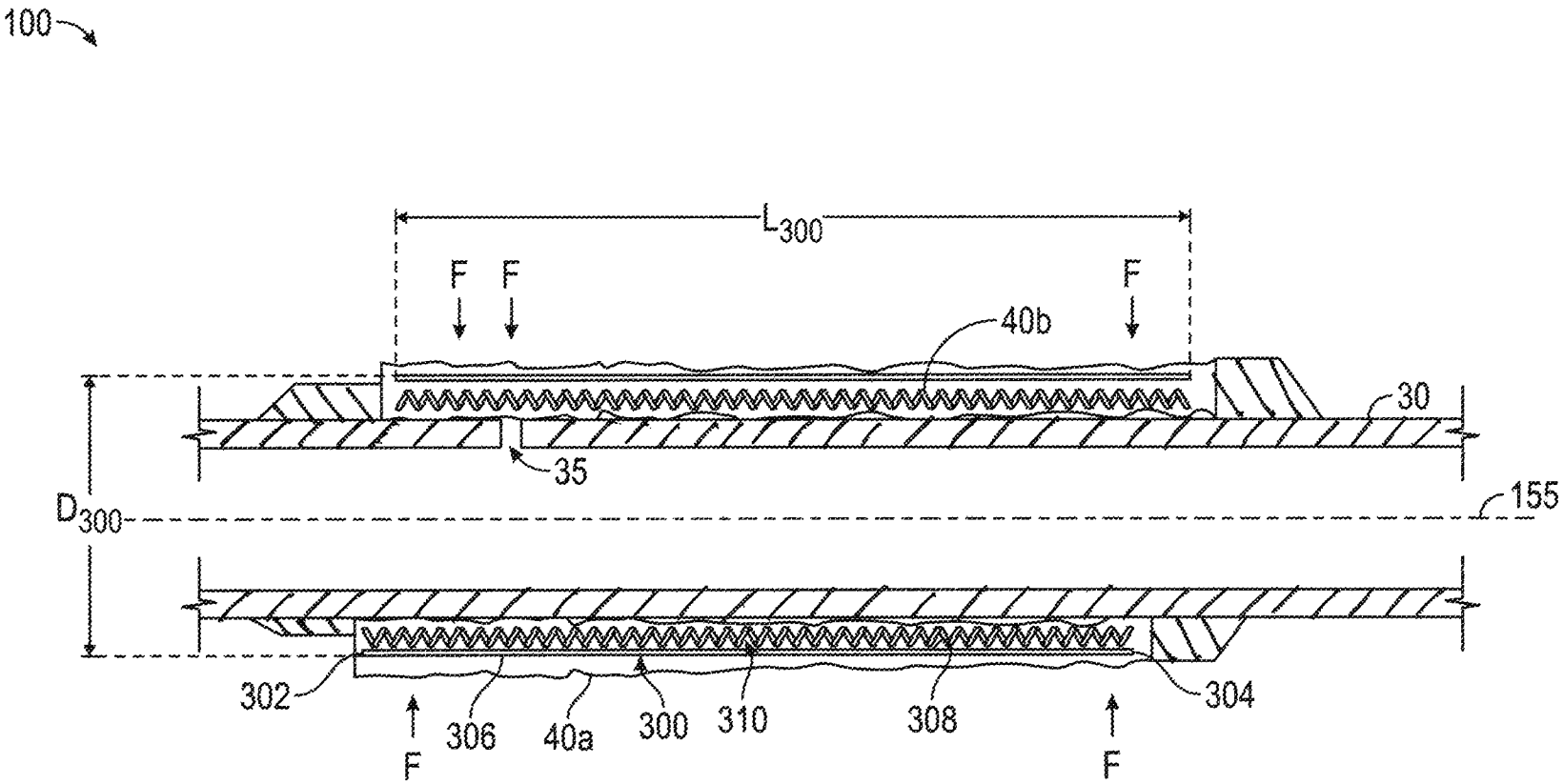
FIG. 3 is a cross sectional view of a portion of the protection sleeve assembly of FIG. 3.

Referring now to FIG. 3, an embodiment of the temporary sealing device 100 comprises a sleeve portion 300 with a similar geometry as the sleeve portion 200 shown in FIGS. 2A and 2B. The sleeve portion 300 of FIG. 3 is coaxial about central axis 155, and is generally tubular with a first end 302, a second end 304, an outer surface 306 extending therebetween, and an inner surface 308 defining a passageway 310. The sleeve portion 300 has a length $L_{300}$ and a diameter $D_{300}$, and may also be called a sleeve, a tube, or a tubular sleeve 300. In some embodiments, sleeve portion 300 may exhibit a C-shaped or other non-circular cross section. The sleeve 300 is made of a degradable material that may be a metal, a glass, or a polymer. In an embodiment, the sleeve 300 may be made of a degradable metal including, but not limited to, aluminum alloys, magnesium alloys, and calcium alloys. Sleeve 300 may be one long sleeve or a plurality of sleeves placed axially end to end. In an embodiment, the length $L_{300}$ of each sleeve 300 may be approximately one inch long to over thirty feet long, and preferably, may be approximately six inches to twenty-four inches long.

The sleeve 300 is disposed about the outside of a downhole component, such as tubing string 30. Sleeve 300 is positioned around tubing 30 to overlap or cover one or more apertures or perforations 35 in the tubing 30 through which production flow path 50 passes. The one or more apertures or perforations 35 may be any type of hole or grouping of holes including, but not limiting to, production tubing holes, workover string holes, and tubular string holes. The quantity, configuration, and spacing of the sleeves 300 may depend on the quantity and location of apertures or perforations 35 to be blocked or covered. In an embodiment, one long sleeve 200 or a plurality of sleeves placed axially end to end may be used to overlap or cover one or more apertures or perforations 35. In another embodiment, a plurality of sleeves 300 of the same length or varying lengths may be spaced apart with each sleeve 300 overlapping or covering one or more apertures or perforations. The one or more apertures or perforations 35 may be a single aperture, a plurality of single apertures spaced apart, a group or cluster of apertures, or a plurality of clusters of apertures with each cluster spaced apart from another cluster. Thus, one sleeve 300 may cover or block a single perforation or hole 35, a group of holes, or multiple groups of holes. For example, sleeve 300 may be used to cover or block a screen joint.

In some embodiments, a restriction device 250 (FIG. 2B) may be disposed directly over the aperture or perforation 35 illustrated in FIG. 3. Thus, the sleeve portion 300 may be employed with an ICD/AICD/ICV/AICV to control flow through the perforation 35.

The diameter $D_{300}$ of sleeve 300 is generally sized to fit around tubing string 30. In an embodiment, sleeve 300 may be formed from a sheet of degradable material wrapped around tubing 30 with an amount of the sheet overlapping itself and secured in place. In another embodiment, sleeve 300 may be a tube that slides over tubing 30. Unless otherwise specified, the subsequent description of sleeve 300 relates to both the wrap around embodiment and the sliding tube embodiment. In an embodiment, sleeve 300 is layered with one or more shrouds, screen jackets, or mesh filters 40*a*, 40*b*, . . . 40*n* (collectively, 40) about the tubing string 30. The embodiment shown in FIG. 3 includes both a screen jacket 40*a* and a mesh filter 40*b*. In an embodiment, a plurality of shrouds, screen jackets, and mesh filters, in any combination, may be used.

The sleeve 300 with any shroud and/or filter layers 40 may be held in place around tubing string 30 by a swedging process. In some embodiments, the screen jacket 40*a* and the sleeve portion 300 may be swedged together over the tubing 30. In other embodiments, the sleeve portion 300 may be swedged directly onto the tubing 30, and the screen jacket 40*a* and/or the mesh filters 40*b* may be wrapped over and around the sleeve portion 300. In the embodiment shown in FIG. 3, the sleeve 300 is swedged (or crimped) to a smaller diameter. The sleeve 300 is mechanically deformed by applying a force F proximate the ends 302, 304 of sleeve 300 and axially inward toward the sleeve outer surface 306 to keep the sleeve in place around tubing string 30 and create a seal by blocking flow between the inner diameter and the outer diameter of the tubing string 30. The mechanical deformation may be performed by any means standard in the art including, but not limited to, mechanical force, pressure, and hydraulic forces. The mechanical deformation may be performed at the surface prior to installation in the wellbore 12 (FIG. 1) using ring clamps or vices, or other crimping tools recognized in the art.

During the mechanical deformation, the sleeve is stretched and then recoils back an amount generally less than the initial stretch amount. In an embodiment, the force F applied only mechanically deforms the sleeve 300, leaving the tubing string 30 not yielded. In another embodiment, during the mechanical deformation, the force F applied to sleeve 300 is great enough to plastically deform both the sleeve 300 and the tubing string 30 inside of the sleeve 300. The amount of elastic recoil is dependent on the material used for the sleeve 300, as well as the thickness of the sleeve, which determines how the material yields when pressurized, activated, or mechanically deformed.

Figure 4:
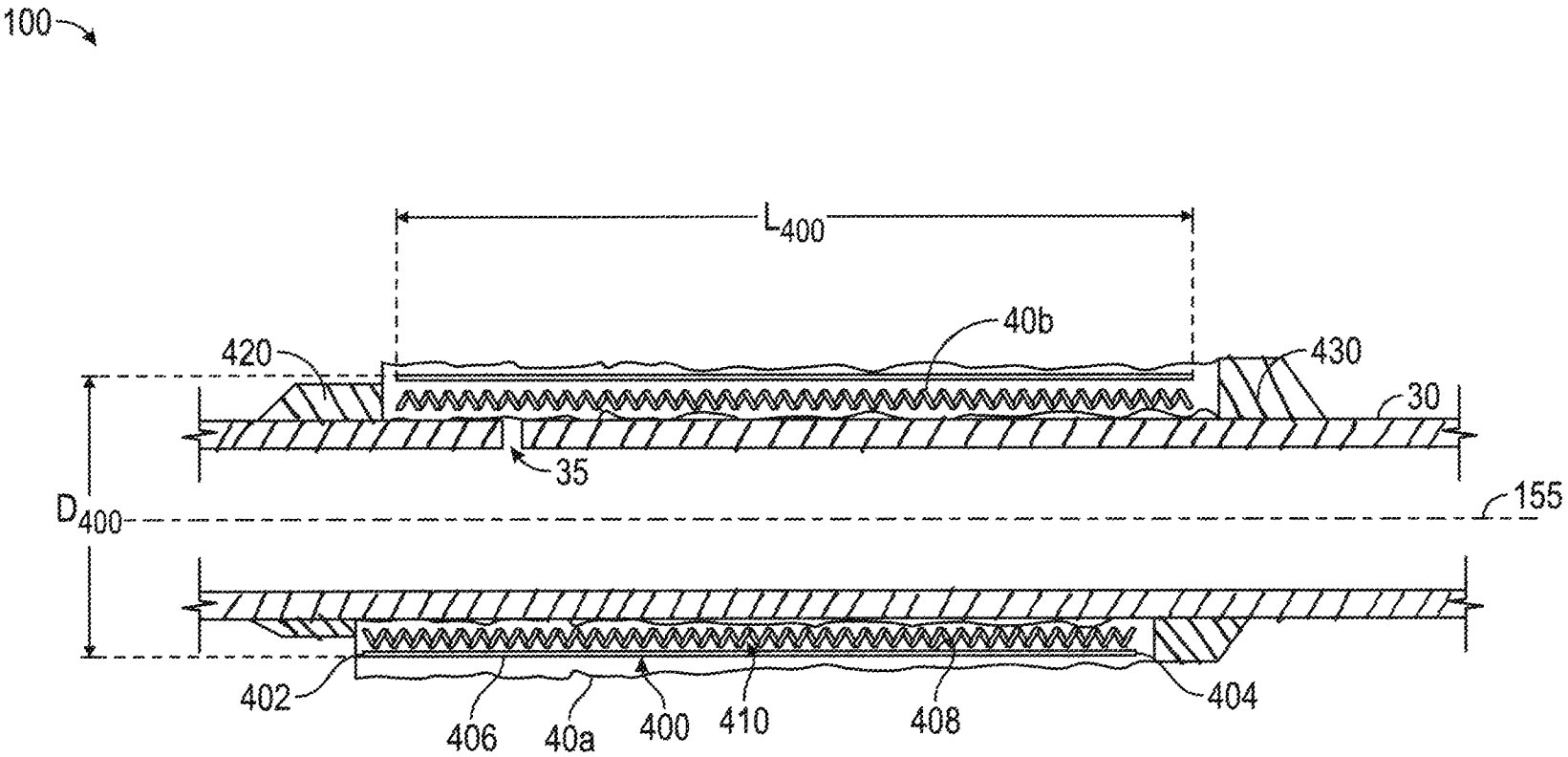
FIG. 4 is a cross sectional view of a portion of the protection sleeve assembly of FIG. 3.

Referring now to FIG. 4, an embodiment of the temporary sealing device 100 comprises a sleeve portion 400 with a similar geometry as the sleeve portion 300 shown in FIG. 3. The sleeve portion 400 of FIG. 4 is coaxial about central axis 155, and is generally tubular with a first end 402, a second end 404, an outer surface 406 extending therebetween, and an inner surface 408 defining a passageway 410. The sleeve portion 400 has a length $L_{400}$ and a diameter $D_{400}$, and may also be called a sleeve, a tube, or a tubular sleeve 400. The sleeve 400 is made of a degradable material that may be a metal, a glass, or a polymer. Sleeve 400 may be one long sleeve or a plurality of sleeves placed axially end to end. In an embodiment, the sleeve 400 may be made of a degradable metal including, but not limited to, aluminum alloys, magnesium alloys, and calcium alloys. In an embodiment, the length $L_{400}$ of each sleeve 400 may be approximately one inch long to over thirty feet long, and preferably, may be approximately six inches to twenty-four inches long.

The sleeve 400 is disposed about the outside of a downhole component, such as tubing string 30. Sleeve 400 is positioned around tubing 30 to overlap or cover one or more apertures or perforations 35 in the tubing 30 through which production flow path 50 passes. The one or more apertures may be any type of hole or grouping of holes including, but not limiting to, production tubing holes, workover string holes, and tubular string holes. The quantity, configuration, and spacing of the sleeve 400 may depend on the quantity and location of apertures or perforations 35 to be blocked or covered. In an embodiment, a plurality of sleeves 400 of the same length or varying lengths may be spaced apart with each sleeve 400 overlapping or covering one or more apertures or perforations. The one or more apertures or perforations 35 may be a single aperture, a plurality of single apertures spaced apart, a group or cluster of apertures, or a plurality of clusters of apertures with each cluster spaced apart from another cluster. Thus, one sleeve 400 may cover or block a single perforation or hole 35, a group of holes, or multiple groups of holes. For example, sleeve 400 may be used to cover or block a screen joint.

In some embodiments, a restriction device 250 (FIG. 2B) may be disposed directly over the aperture or perforation 35 illustrated in FIG. 4. Thus, the sleeve portion 400 may be employed with an ICD/AICD/ICV/AICV to control flow through the perforation 35.

The diameter $D_{400}$ of sleeve 400 is generally sized to fit around tubing string 30. In an embodiment, sleeve 400 may be formed from a sheet of degradable material wrapped around tubing 30 with an amount of the sheet overlapping itself and secured in place. In another embodiment, sleeve 400 may be a tube that slides over tubing 30. Unless otherwise specified, the subsequent description of sleeve 400 relates to both the wrap around embodiment and the sliding tube embodiment. In an embodiment, sleeve 400 is layered with one or more shrouds or mesh filters 40*a*, 40*b*, . . . 40*n* (collectively, 40) about the tubing string 30. The embodiment shown in FIG. 4 includes both a screen jacket 40*a* and a mesh filter 40*b*. In an embodiment, a plurality of shrouds, screen jackets, and mesh filters, in any combination, may be used.

The sleeve 400 with any shrouds, screen jackets, and/or filter layers 40 may be held in place around tubing string 30 by any means known in the art that sealingly secures sleeve 400 to tubing 30 including, but not limited to, mechanical fasteners and adhesives. In the embodiment shown in FIG. 4, sleeve 400 is held in place at first end 402 by a first mechanical fastener 420 and at second end 404 by a second mechanical fastener 430 to keep the sleeve in place around tubing string 30 and create a seal by blocking flow between the inner diameter and the outer diameter of the tubing string 30. The mechanical fasteners and adhesives may be applied to sleeve 400 at the surface prior to installation in the wellbore.

Figure 5A:
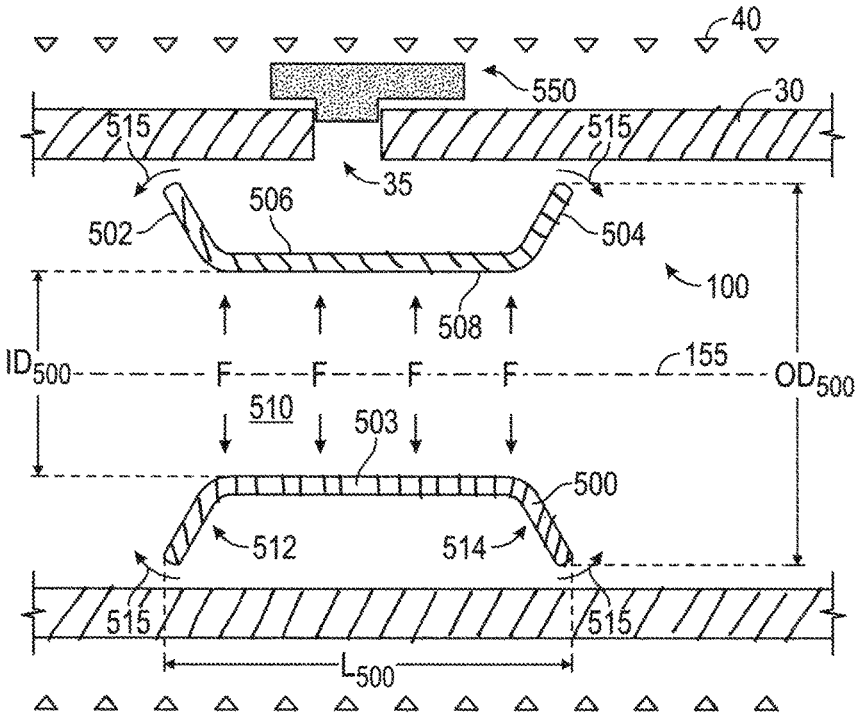
FIGS. 5A and 5B are a cross sectional views of a portion of the protection sleeve assembly of FIG. 3.

Referring now to FIG. 5A, an embodiment of the temporary sealing device 100 comprises a sleeve portion 500 with a similar geometry as the sleeve portion 200 shown in FIGS. 2A and 2B with the addition of angular extensions. The sleeve portion 500 of FIG. 5A is coaxial about central axis 155, and is generally tubular with a first end 502, a second end 504, a central portion 503, an outer surface 506 extending therebetween, and an inner surface 508 defining a passageway 510. The sleeve portion 500 has an overall length $L_{500}$ and an inner diameter $ID_{500}$, and may also be called a sleeve, a tube, or a tubular sleeve 500. The sleeve portion 500 further includes a first angular extension 512 extending radially outward from central portion 503 toward first end 502, and a second angular extension 514 extending radially outward from central portion 503 toward second end 504. In an embodiment, the first and second angular extensions 512, 514 are approximately the same size and form an outer diameter $OD_{500}$. In an alternative embodiment, the first angular extension 512 may be a different size, either smaller or larger, than the second angular extension 514. The sleeve 500 is made of a degradable material that may be a metal, a glass, or a polymer. In an embodiment, the sleeve 500 may be made of a degradable metal including, but not limited to, aluminum alloys, magnesium alloys, and calcium alloys. Sleeve 500 may be one long sleeve or a plurality of sleeves spaced apart, end to end, or partially overlapping one another in an axial direction. In an embodiment, the overall length $L_{500}$ of each sleeve 500 may be approximately one inch long to over thirty feet long, and preferably, may be approximately six inches to twenty-four inches long.

The sleeve 500 is disposed within a downhole component, such as tubing string 30. Sleeve 500 is positioned within tubing 30 to overlap or cover one or more apertures or perforations 35 in the tubing 30 through which a production flow path 50 passes. The one or more apertures may be any type of hole or grouping of holes including, but not limiting to, production tubing holes, workover string holes, and tubular string holes. The quantity, configuration, and spacing of the sleeves 500 may depend on the quantity and location of apertures or perforations 35 to be blocked or covered. In an embodiment, one long sleeve 500 may be used to overlap or cover one or more apertures or perforations. In another embodiment, a plurality of sleeves 500 of the same length or varying lengths and be spaced apart with each sleeve 500 overlapping or covering one or more apertures or perforations. The one or more apertures or perforations 35 may be a single aperture, a plurality of single perforations spaced apart, a group or cluster of perforations, or a plurality of clusters of apertures with each cluster spaced apart from another cluster. Thus, one sleeve 500 may cover or block a single perforation or hole 35, a group of perforations, or multiple groups of perforations. For example, sleeve 500 may be used to cover or block a screen joint.

The outer diameter $OD_{500}$ of sleeve 500 is generally sized to fit within tubing string 30 and may or may not be in contact with an inner surface of the tubing string 30. A shroud or a mesh filter 40 may be disposed about the tubing string 30. In an embodiment both a shroud and a mesh filter may be used; in a further embodiment, a plurality of shrouds, a plurality of mesh filters, or a plurality of both shrouds and mesh filters may be used.

Figure 5B:
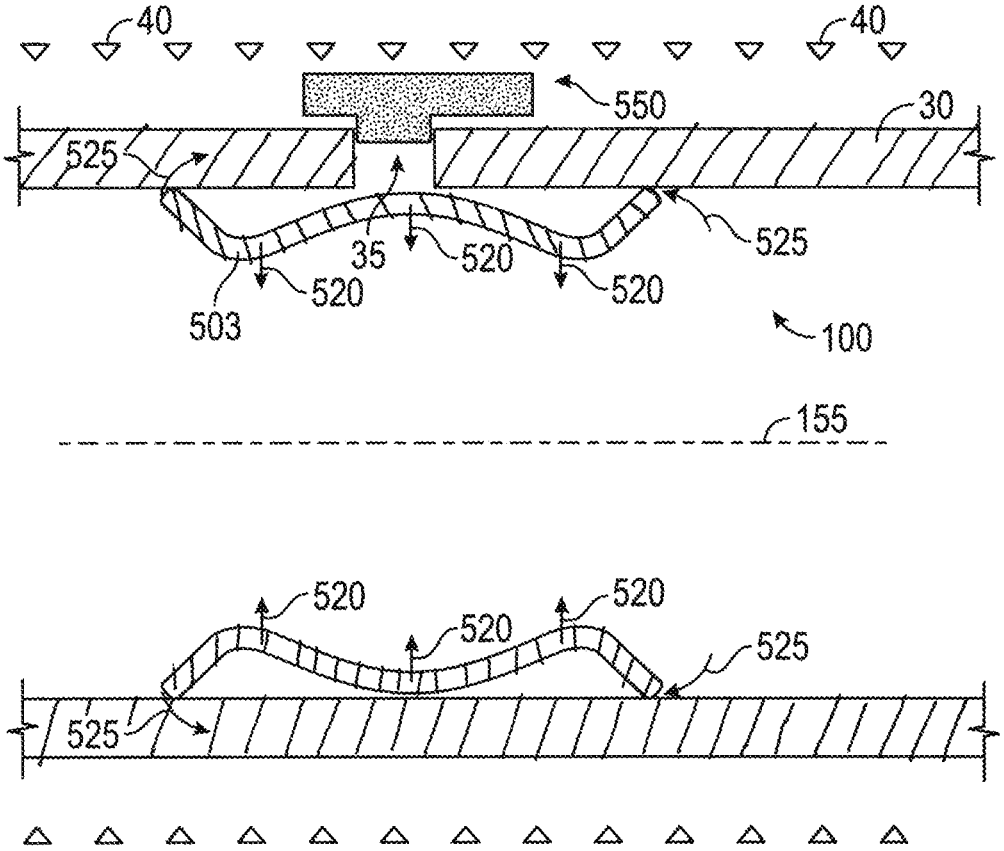

Referring now to FIGS. 5A and 5B, the sleeve 500 is held in place within tubing string 30 by a swedging process. The sleeve 500 is mechanically deformed by applying a force F axially outward to the sleeve inner surface 508 along central portion 503 to keep the sleeve in place within tubing string 30 and block flow through aperture 35 between the inner diameter and the outer diameter of the tubing string 30. The mechanical deformation may be performed by any means standard in the art including, but not limited to, a mechanical cone, a hydraulic setting tool, an expandable packer, explosive forming, pressure, and hydraulic forces. The mechanical deformation may be done at the surface prior to installation in the wellbore or after the completion is installed.

In the embodiment shown in FIGS. 5A and 5B, the sleeve 500 is swedged to a larger diameter. During the mechanical deformation, the central portion 503 bows radially outward as shown in FIG. 5B, and the first and second angular extensions 512, 514 are pressed against the inner diameter of the tubing 30 and may rotate or bend axially away from central portion 503 (indicated by arrows 515 in FIG. 5A). When the mechanical load (e.g., force F) is removed, there is elastic recoil from residual stress within central portion 503 and residual bending stress in the first and second angular extensions 512, 514 that causes sleeve 500 to recoil back an amount generally less than the initial stretch amount. Central portion 503 recoils back radially inward (indicated by arrows 520 in FIG. 5B) and first and second angular extensions 512, 514 recoil back axially toward central portion 503 (indicated by arrows 525 in FIG. 5B). The recoil movement of the central portion 503 and the first and second angular extensions 512, 514 produces an intimate contact between the sleeve 500 and tubing 30 to block flow through aperture 35.

The temporary sealing device 100 of FIGS. 5A and 5B may further include a flow restriction device 550 disposed in or covering one of the apertures 35. The flow restriction device 550 may be used to control flow (e.g., production flow path 50) through one of the apertures 35. The flow restriction device may be any flow control device standard in the art including, but not limited to, an inflow control device (ICD), an autonomous inflow control device (AICD), an autonomous inflow control valve (AICV), and an inflow control valve (ICV). One or more restriction devices 550 may be used in various apertures or holes 35 at various locations in the tubing string 30.

Each embodiment of the temporary sealing device 100 described herein, including sleeves 200, 300, 400, 500, is made of a degradable material. As previously described, the sleeve is made of a degradable material that may be a metal, a glass, or a polymer; in particular, the sleeve may be made of a degradable metal including, but not limited to, aluminum alloys, magnesium alloys, and calcium alloys. The timeframe in which the sleeve degrades or dissolves depends on the material used for the sleeve, the thickness and geometry of the sleeve, and the environment and fluids the sleeve is exposed to in the wellbore. For example, the sleeve may galvanically react with wellbore brine and dissolve. The sleeve may degrade in as little as twelve hours, or may take as long as a month or more to degrade. In an embodiment, the degradation of the sleeve may be accelerated by circulating an acid into the wellbore. In an alternative embodiment, the degradation of the sleeve may be delayed by adding a coating to the sleeve; the coating may be added during the manufacturing process or during installation of the sleeve into the wellbore.

Figure 6:
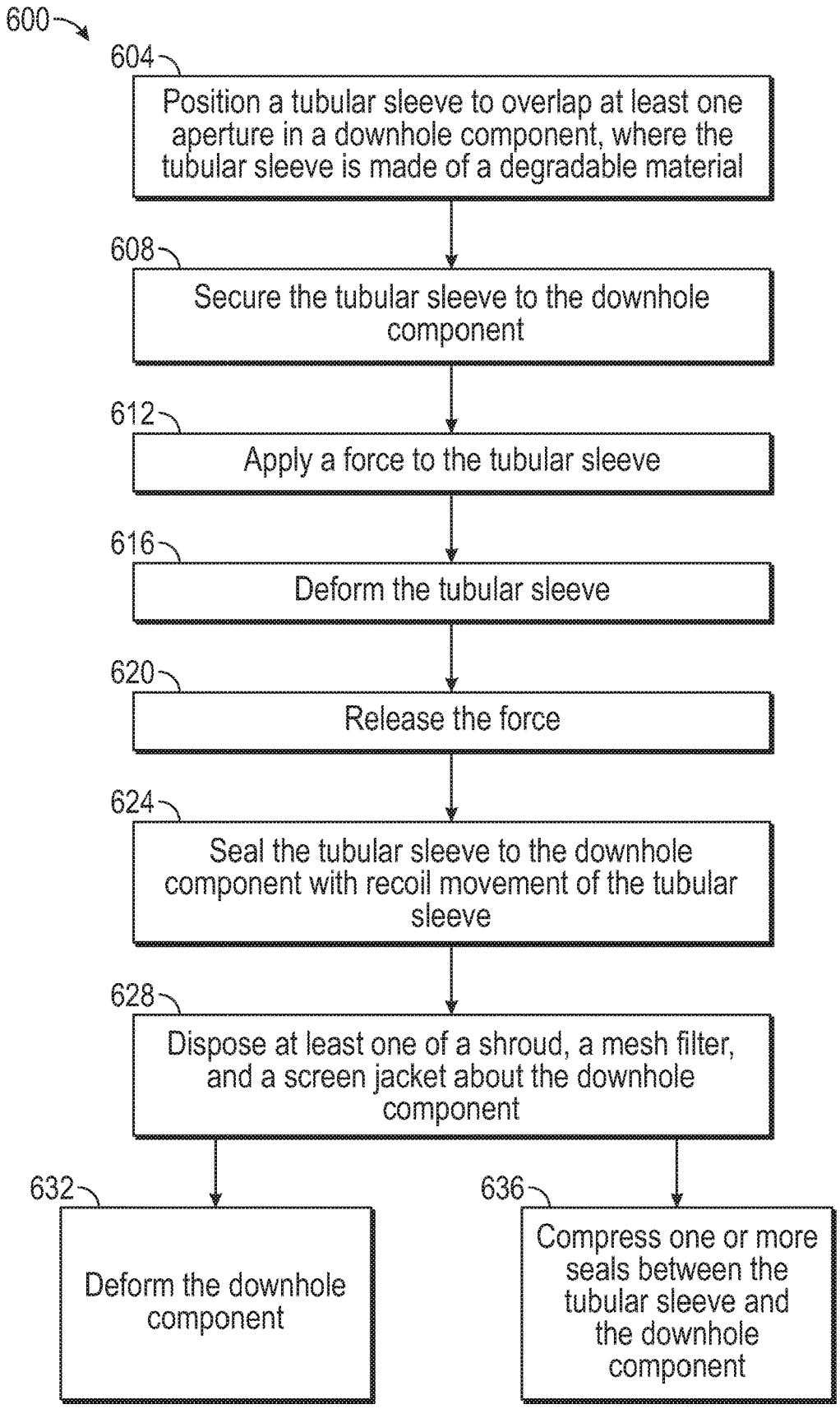
FIG. 6 illustrates embodiments of a method for retrieving the protection sleeve assembly of FIG. 3.

In an exemplary embodiment and as illustrated in FIG. 6, with continuing reference to FIGS. 1-5, a method 600 of providing a temporary seal for a downhole component having at least one aperture to block fluid flow through the at least one aperture is described. The method 600 may be utilized for temporarily blocking fluid flow through the at least one aperture and between the inner and outer diameters of the downhole component (e.g., tubing 30). For example, during installation, wellbore cleanup, hydraulic fracturing, or refracturing applications. The tubular sleeve material is degradable and once degraded will allow fluid flow through the at least one aperture.

In a first step 604, a tubular seal (see e.g., 200, 300, 400, 500) is positioned to overlap at least one aperture 35 in a downhole component (e.g., tubing string 30), where the tubular sleeve is made of a degradable material. In an embodiment, the tubular sleeve may be positioned in the downhole component at the surface prior to installation in the wellbore or after the downhole component is installed.

In step 608, the tubular sleeve is secured to the downhole component. The tubular sleeve may be secured to the downhole component at the surface prior to installation in the wellbore or after the downhole component is installed.

In step 612, a force F is applied to the tubular sleeve. In an embodiment, the force F may be applied radially inward (see FIG. 3) or may be applied radially outward (see FIGS. 2A, 2B, 5A, and 5B). In step 616, the tubular sleeve is deformed; and in step 620, the force is released.

In step 624, the tubular sleeve is sealed to the downhole component with the recoil movement of the tubular sleeve. The tubular sleeve covers one or more apertures 35 and prevents fluid flow between the inside and outside diameters of the downhole component (e.g., tubing string 30).

In step 628, a filter media such as at least one of a shroud, a mesh filter, and a screen jacket (e.g., shroud, mesh filter, etc. 40) is disposed about the downhole component. In step 632, the downhole component is deformed (see e.g., FIG. 3). In an alternative embodiment, shown in step 636, one or more seals between the tubular sleeve and the downhole component is compressed (see FIGS. 2A and 2B).

The aspects of the disclosure described below are provided to describe a selection of concepts in a simplified form that are described in greater detail above. This section is not intended to identify key features or essential features of the claimed subject matter, no intended to be used as an aid in determining the scope of the claimed subject matter.

In one aspect, the disclosure is directed to a temporary sealing device for a downhole component having at least one aperture to block fluid flow through the at least one aperture. The device includes a tubular sleeve having a first end, a second end, an outer surface, and an inner surface forming a passageway. The tubular sleeve is made of a degradable material and disposed inside the downhole component and overlapping the at least one aperture. At least one filter media is disposed about the downhole component.

In one or more example embodiments, the device further includes a first seal disposed around the outer surface and proximate the first end and a second seal disposed around the outer surface and proximate the second end. The first and second seals are made of a degradable material. The first seal may be disposed in a first groove in the outer surface, and the second seal may be disposed in a second groove in the outer surface. In some embodiments, the device further includes a first molded seal disposed around the outer surface and proximate the first end and a second molded seal disposed around the outer surface and proximate the second end. The first and second molded seals are made of a degradable material.

In some embodiments, the device further includes a restriction device disposed in or covering the at least one aperture. In some embodiments, the device includes an additional tubular sleeve having a first end, a second end, an outer surface, and an inner surface forming a passageway, and the additional tubular sleeve is made of a degradable material, overlaps a second aperture in the downhole component, and is disposed adjacent the tubular sleeve. In one or more embodiments, the device further includes a first angular extension extending radially outward from a central portion of the tubular sleeve toward the first end and a second angular extension extending radially outward from a central portion of the tubular sleeve toward the second end.

According to another aspect, the disclosure is directed to a temporary sealing device for a downhole component having at least one aperture to block fluid flow through the at least one aperture. The device includes a tubular sleeve having a first end, a second end, an outer surface, and an inner surface forming a passageway, the tubular sleeve being made of a degradable material and disposed around an outside surface of the downhole component and overlapping the at least one aperture. The device also includes at least one filter media disposed about the downhole component.

In some example embodiments, the device further includes a first mechanical fastener disposed at the first end, and a second mechanical fastener disposed at the second end. The first and second mechanical fasteners may form a seal by blocking flow through the at least one aperture. In some embodiments, the device further includes a first adhesive fastener disposed at the first end and a second adhesive fastener disposed at the second end. The first and second adhesive fasteners may form a seal by blocking flow through the at least one aperture.

According to another aspect, the disclosure is directed to a method for providing a temporary seal for a downhole component having at least one aperture to block fluid flow through the at least one aperture. The method includes (a) positioning a tubular sleeve to overlap the at least one aperture in the downhole component, the tubular sleeve being made of a degradable material, and (b) securing the tubular sleeve to the downhole component.

In some embodiments, securing the tubular sleeve to the downhole component includes applying a force to the tubular sleeve, deforming the tubular sleeve, releasing the force and sealing the tubular sleeve to the downhole component with recoil movement of the tubular sleeve. In some embodiments, the method further includes disposing at least one filter media about the downhole component.

In one or more example embodiments, the tubular sleeve is disposed on an outside surface of the downhole component. In some embodiments, the method further includes deforming the downhole component.

In some embodiments, the tubular sleeve is disposed inside the downhole component. Some embodiments further include compressing one or more seals between the tubular sleeve and the downhole component.

In some example embodiments, the method further includes positioning an additional tubular sleeve to overlap a second aperture in the downhole component, the additional tubular sleeve being made of a degradable material, and securing the additional tubular sleeve to the downhole component. In some embodiments, the additional tubular sleeve is spaced away from the tubular sleeve. The additional tubular sleeve may be disposed adjacent the tubular sleeve.

While various embodiments have been illustrated in detail, the disclosure is not limited to the embodiments shown. Modification and adaptation of the above embodiments may occur to those skilled in the art. Such modifications and adaptations are in the spirit and scope of the disclosure.

The invention claimed is:

1. A temporary sealing device for a downhole component having at least one aperture to block fluid flow through the at least one aperture, the device comprising:

a tubular sleeve having a first end, a second end, an outer surface, and an inner surface forming a passageway, the tubular sleeve being made of a degradable material and disposed inside the downhole component and overlapping the at least one aperture; and at least one filter media disposed about the downhole component.

2. The device of claim 1, further comprising:

a first seal disposed around the outer surface and proximate the first end; and a second seal disposed around the outer surface and proximate the second end;

wherein the first and second seals are made of a degradable material.

3. The device of claim 2, wherein the first seal is disposed in a first groove in the outer surface, and the second seal is disposed in a second groove in the outer surface.

4. The device of claim 3, further comprising:

a first molded seal disposed around the outer surface and proximate the first end; and a second molded seal disposed around the outer surface and proximate the second end;

wherein the first and second molded seals are made of a degradable material.

5. The device of claim 1, further comprising a restriction device disposed in or covering the at least one aperture.

6. The device of claim 1, further comprises:

an additional tubular sleeve having a first end, a second end, an outer surface, and an inner surface forming a passageway, wherein the additional tubular sleeve is made of a degradable material, overlaps a second aperture in the downhole component, and is disposed adjacent the tubular sleeve.

7. The device of claim 1, further comprising:

a first angular extension extending radially outward from a central portion of the tubular sleeve toward the first end; and a second angular extension extending radially outward from the central portion of the tubular sleeve toward the second end.

8. A temporary sealing device for a downhole component having at least one aperture to block fluid flow through the at least one aperture, the device comprising:

a tubular sleeve having a first end, a second end, an outer surface, and an inner surface forming a passageway, the tubular sleeve being made of a degradable material and disposed around an outside surface of the downhole component and overlapping the at least one aperture; and at least one filter media disposed about the downhole component;

wherein the tubular sleeve is sealed onto the downhole component by plastically deforming the tubular sleeve using a radially inward force.

9. The device of claim 8, further comprising:

a first mechanical fastener disposed at the first end; and a second mechanical fastener disposed at the second end;

wherein the first and second mechanical fasteners form a seal by blocking flow through the at least one aperture.

10. The device of claim 8, further comprising:

a first adhesive fastener disposed at the first end; and a second adhesive fastener disposed at the second end;

wherein the first and second adhesive fasteners form a seal by blocking flow through the at least one aperture.

11. A method for providing a temporary seal for a downhole component having at least one aperture to block fluid flow through the at least one aperture, the method comprising:

positioning a tubular sleeve to overlap the at least one aperture in the downhole component, the tubular sleeve being made of a degradable material; and securing the tubular sleeve to the downhole component;

wherein the tubular sleeve is disposed on an outside surface of the downhole component and securing the tubular sleeve to the downhole component comprises:

applying a radially inward force to the tubular sleeve;

plastically deforming the tubular sleeve; and releasing the force; or wherein the tubular sleeve is disposed on an inner surface of the downhole component and securing the tubular sleeve to the downhole component comprises:

applying a radially outward force to the tubular sleeve;

plastically deforming the tubular sleeve; and releasing the force.

12. The method of claim 11, wherein securing the tubular sleeve to the downhole component comprises:

sealing the tubular sleeve to the downhole component with recoil movement of the tubular sleeve.

13. The method of claim 11, further comprising disposing at least one filter media about the downhole component.

14. The method of claim 11, wherein the tubular sleeve is disposed on the outside surface of the downhole component.

15. The method of claim 14, further comprising deforming the downhole component.

16. The method of claim 11, wherein the tubular sleeve is disposed on the inside surface of the downhole component.

17. The method of claim 16, further comprising compressing one or more seals between the tubular sleeve and the downhole component.

18. The method of claim 11, further comprising:

positioning an additional tubular sleeve to overlap a second aperture in the downhole component, the additional tubular sleeve being made of a degradable material; and securing the additional tubular sleeve to the downhole component.

19. The method of claim 18, wherein the additional tubular sleeve is spaced away from the tubular sleeve.

20. The method of claim 18, wherein the additional tubular sleeve is disposed adjacent the tubular sleeve.

* * * * *